US006452137B1

(12) United States Patent
Kariya

(10) Patent No.: US 6,452,137 B1
(45) Date of Patent: Sep. 17, 2002

(54) CERAMIC HEATER

(75) Inventor: Satoru Kariya, Gifu (JP)

(73) Assignee: Ibiden Co., Ltd., Gifu (JP)

( * ) Notice: Subject to any disclaimer, the term of this patent is extended or adjusted under 35 U.S.C. 154(b) by 0 days.

(21) Appl. No.: 09/807,431

(22) PCT Filed: Sep. 7, 2000

(86) PCT No.: PCT/JP00/06109

§ 371 (c)(1),
(2), (4) Date: Apr. 23, 2001

(87) PCT Pub. No.: WO01/19139

PCT Pub. Date: Mar. 15, 2001

(30) Foreign Application Priority Data

Sep. 7, 1999 (JP) ..... 11/252926

(51) Int. Cl.[7] ..... H05B 3/10; H05B 3/44
(52) U.S. Cl. ..... 219/544; 219/553
(58) Field of Search ..... 219/520, 532, 219/534, 538, 542, 543, 544, 546, 548, 552, 553, 270; 501/97

(56) References Cited

U.S. PATENT DOCUMENTS

| | | | | |
|---|---|---|---|---|
| 4,555,358 A | | 11/1985 | Matsushita et al. | |
| 4,613,455 A | | 9/1986 | Suzuki et al. | |
| 5,350,720 A | * | 9/1994 | Kawada et al. | 501/97 |
| 5,616,024 A | | 4/1997 | Nobori et al. | |
| 5,665,260 A | | 9/1997 | Kawada et al. | |
| 5,683,606 A | | 11/1997 | Ushikoshi et al. | |
| 5,753,893 A | | 5/1998 | Noda et al. | |
| 5,756,215 A | | 5/1998 | Sawamura et al. | |
| 6,013,898 A | * | 1/2000 | Mizuno et al. | 219/270 |
| 6,025,579 A | | 2/2000 | Tanaka et al. | |
| 6,130,410 A | | 10/2000 | Kita | |
| 6,143,238 A | | 11/2000 | Konishi et al. | |
| 6,236,028 B1 | * | 5/2001 | Shirai et al. | 219/543 |
| 6,265,700 B1 | * | 7/2001 | Miyata et al. | 219/544 |
| 6,294,769 B1 | * | 9/2001 | McCarter | 219/544 |
| 6,294,771 B2 | * | 9/2001 | Katsuda et al. | 219/544 |

FOREIGN PATENT DOCUMENTS

| | | |
|---|---|---|
| DE | 19757752 | 7/1998 |
| EP | 0635993 | 1/1995 |
| EP | 0701979 | 3/1996 |
| EP | 0720416 | 7/1996 |
| EP | 0848209 | 6/1998 |
| EP | 093342 | 8/1999 |
| JP | 61114487 | 6/1986 |
| JP | 02112192 | 4/1990 |
| JP | 06013161 | 1/1994 |
| JP | 06068959 | 3/1994 |
| JP | 08335492 | 12/1996 |
| JP | 11040330 | 2/1999 |

OTHER PUBLICATIONS

Patent Abstract of Japan, vol. 1997, No. 04, Apr. 30, 1997.
English Language Abstract of JP 61–114487.
English Language Abstract of JP 08–335492.
English Language Abstract of JP 11–040330.
English Language Abstract of JP 06–068959.
English Language Abstract of JP 06–013161.
English Language Abstract of JP 02–112192.

* cited by examiner

*Primary Examiner*—Tu Ba Hoang
(74) *Attorney, Agent, or Firm*—Greenblum & Bernstein, P.L.C.

(57) ABSTRACT

In a ceramic heater comprising a heating body formed on a surface of a ceramic substrate, the heating body is made of a non-sintering type metal foil or an electrically conductive ceramic thin film, and the metal foil or electrically conductive ceramic thin film is adhered to the surface of the substrate through a heat-resistant resin layer or the like. The ceramic heater is less in the scattering of resistance resulted from the quality of the heating body and is possible to accurately and rapidly conduct temperature control.

20 Claims, 3 Drawing Sheets

CERAMIC HEATER

TECHNICAL FIELD

This invention relates to a ceramic heater mainly used in a semiconductor industry as a static chuck, wafer prober or the like for drying or sputtering treatment, and more particularly it proposes a ceramic heater changing no resistance value even in a long-time use in an oxidizing atmosphere and having an excellent temperature controllability.

BACKGROUND ART

Semiconductor products are generally produced by etching a silicon wafer with a photosensitive resin as an etching resist to form electronic circuits or the like. In such a production method, the liquid photosensitive resin applied onto the surface of the silicon wafer should be dried after the application through a spin-coater. For this end, the drying is carried out by heating the silicon wafer coated with the photosensitive resin by means of a heater.

As such a heater, there has hitherto been used one obtained by forming a heating body on a rear surface of a metallic substrate such as aluminum or the like.

When the heater using such a metallic substrate is used in the drying of the semiconductor product, however, there are the following problems. That is, the substrate of the heater is a metal, so that the thickness of the substrate should be thickened to about 15 mm. Because, when using a thin metal substrate, warping or strain is caused due to thermal expansion resulted from the heating, which affects the wafer placed on such a metallic substrate and heated thereby to cause breakage or tilting. Meanwhile, this problem can be solved by thickening the substrate, but the weight of the heater is increased and becomes bulky.

Further, when the heating temperature of the heater is controlled by changing a voltage or a current quantity applied to the heating element attached to the substrate, if the thickness of the metallic substrate is thick, the temperature of the substrate does not rapidly follow and vary to the change of voltage or current quantity and there is a problem that the temperature control is difficult.

In this connection, there has hitherto been proposed a ceramic heater using a nitride ceramic as a substrate (JP-A-11-40330).

In this conventional technique, however, electron circuit and heating body formed on the substrate are produced by using a sintered metal, so that the scattering in the thickness of the heating body may be caused and hence there are problems that the resistance value is varied so as not to conduct the accurate temperature control and uniform temperature distribution is caused on a heating face of the semiconductor product as a wafer to be heated.

It is an object of the invention to provide a ceramic heater capable of accurately and rapidly conducting the temperature control without scattering of the resistor resulted from the above problems inherent to the conventional ceramic heater, particularly the quality of the heating body.

DISCLOSURE OF THE INVENTION

The inventors have made studies in order to achieve the above object and found that when the heating body to be: formed in the ceramic heater is formed by using a non-sintering metal foil, e.g. a metal foil formed by rolling or plating (particularly electric plating) instead of the above sintered body, the quality (homogeneity) as a heating body is excellent and the problems inherent to the above sintered heating body can be overcome.

And also, it has been found that even when an electrically conductive ceramic is used as the heating body, the above problems inherent to the sintered heating body can be overcome, when a thin film pattern is previously formed, by;embedding the thin film of the electrically conductive ceramic in the substrate or fixing onto the surface of the substrate through adhesion.

Under the above knowledge, the invention is basically a ceramic heater comprising a ceramic substrate and a heating body formed on a surface of the substrate or in an inside thereof and made of a non-sintering type metal foil or an electrically conductive ceramic thin film. Moreover, the non-sintering type metal foil is substantially the same as the non-sintering metal foil.

And also, the invention lies in a ceramic heater comprising a heating body formed on a surface of a ceramic substrate, characterized in that the heating body is made of a non-sintering type metal foil or an electrically conductive ceramic thin film and the metal foil is adhered and fixed to the surface of the substrate with an insulating material layer.

In addition, the invention lies in a ceramic heater comprising a heating body formed on a surface of a ceramic substrate, characterized in that the heating body is made of a non-sintering type metal foil or an electrically conductive ceramic thin film and the metal foil and the substrate are fixed by covering together with an insulating material.

Furthermore, the invention is basically the formation of a heating body made of a non-sintering type metal foil on a surface of a substrate, and is particularly a ceramic heater comprising a heating body formed on a surface of a substrate or in an inside thereof, characterized in that the heating body is made of a non-sintering type metal foil and the metal foil is adhered and fixed onto the surface of the substrate with a heat-resistant resin layer.

Moreover, the invention is a ceramic heater comprising a heating body formed on a surface of a substrate or in an inside thereof, characterized in that the heating body is made of a non-sintering type metal foil and the metal foil and the substrate are covered and fixed together with a heat-resistant resin.

In the ceramic heater according to the invention, it is desirable that a thickness of the non-sintering type metal foils the non-sintering electrically conductive ceramic thin film is 10–50 $\mu$m, preferably 10–20 $\mu$m.

Moreover, the heating body is desirable to be formed on a face opposite to a heating face.

BEST MODE FOR CARRYING OUT THE INVENTION

The feature of the ceramic heater according to the invention lies in facts that the heating body is formed on the surface of the ceramic substrate or in the inside thereof, and that a non-sintering type metal foil, i.e. a rolling member formed by melting and purifying and then rolling (inclusive of forging) or a dense metal foil such as a plated member obtained by electric plating is used as the heating body. Such a metal foil is uniform in the thickness and dense and small in the scattering of resistance value. And also, even in case of using the electrically conductive ceramic as the heating body, when a thin film pattern is previously formed and placed on the surface of the substrate or embedded in the inside thereof or formed on the surface of the ceramic substrate under an atmosphere shielding condition through a heat-resistant resin layer, the thickness can be made uniform and the aforementioned problems can be overcome.

As the electrically conductive ceramic, it is desirable to use at least one selected from silicon carbide, tungsten carbide, titanium carbide and carbon.

In such an electrically conductive ceramic thin film, a heating body pattern may be formed by etching or punching after the thin film of the electrically conductive ceramic is formed, or a thin film may be rendered into a heating body pattern and then sintered.

The thickness of the non-sintering metal foil or the electrically conductive ceramic thin film is desirable to be 10–50 $\mu$m, preferably 10–20$\mu$m. When the thickness is less than 10 $\mu$m, the handling is difficult in the adhesion to the ceramic substrate, while when it exceeds 50 $\mu$m, the undercut is generated in the etching , which results in the scattering of the resistance value. The metal used is desirable to be at least one selected from metals and alloys such as nickel, stainless steel, nichrome (Ni—Cr alloy), canthal (Fe—Cr—Al alloy) and so on.

As the adhesion form of the above metal foil or the electrically conductive ceramic thin film to the surface of the ceramic substrate, there are advantageously adapted a form wherein an insulating material is first applied onto the full surface of the ceramic substrate and the metal foil is adhered through the insulating material and subjected to a curing treatment (FIG. 2), a form wherein a heat-resistant resin is previously printed on the surface of the ceramic substrate in correspondence to a heating body pattern and the metal foil or the electrically conductive ceramic thin film is adhered on the heat-resistant resin layer and subjected to a curing treatment (FIG. 3) and the like.

Figure 4:
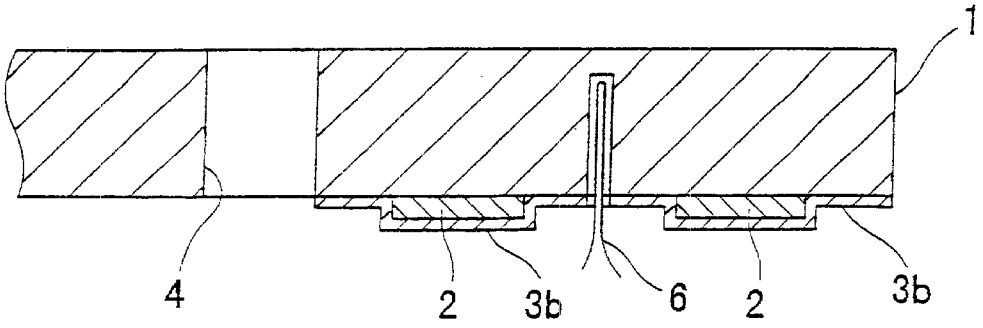
FIG. 4 is a diagrammatically partial section view illustrating the other embodiment of the invention.

As. the other method, there may be a form wherein the metal foil or the electrically conductive ceramic thin film is placed on the surface of the ceramic substrate and an insulating material film of B-stage is covered onto the metal foil or the electrically conductive thin film and hot pressed to cover and fix together with the ceramic substrate (FIG. 4).

Figure 5:
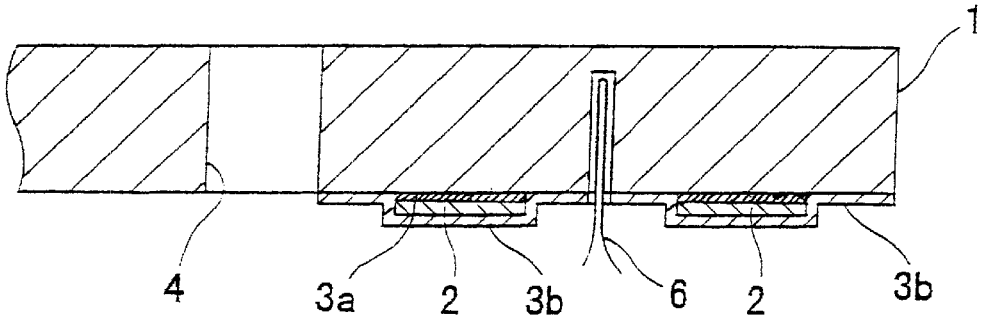
FIG. 5 is a diagrammatically partial section view illustrating a further embodiment of the invention.

And also, as shown in FIG. 5, there may be a form wherein an insulating material layer 3*a* is first applied onto the surface of the ceramic substrate and a pattern of a heating body 2 (metal foil or electrically conductive ceramic thin film) is fixed thereon to and further a heat-resistant resin film 3*b* is covered thereon to and fixed thereto.

As the insulating material, a heat-resistant resin or an inorganic binder may be used. As the inorganic binder, an inorganic sol, a glass paste or the like can be used. The inorganic sol is rendered into an inorganic gel by curing and acts as an inorganic adhesive.

As an example of the heat-resistant resin used in the adhesion of the heating body, a thermosetting resin is desirable, which may be at least one selected from polyimide resin, epoxy resin, phenolic resin, silicon resin and so on.

As the inorganic sol, at least one selected from silica sol, alumina sol and hydrolized polymer of alkoxide can be used.

The inorganic binder such as inorganic sol (inorganic gel after the curing), glass paste and the like is excellent in the heat resistance and does not cause heat degradation and peel the heating body, so that it is favorable.

Figure 1:
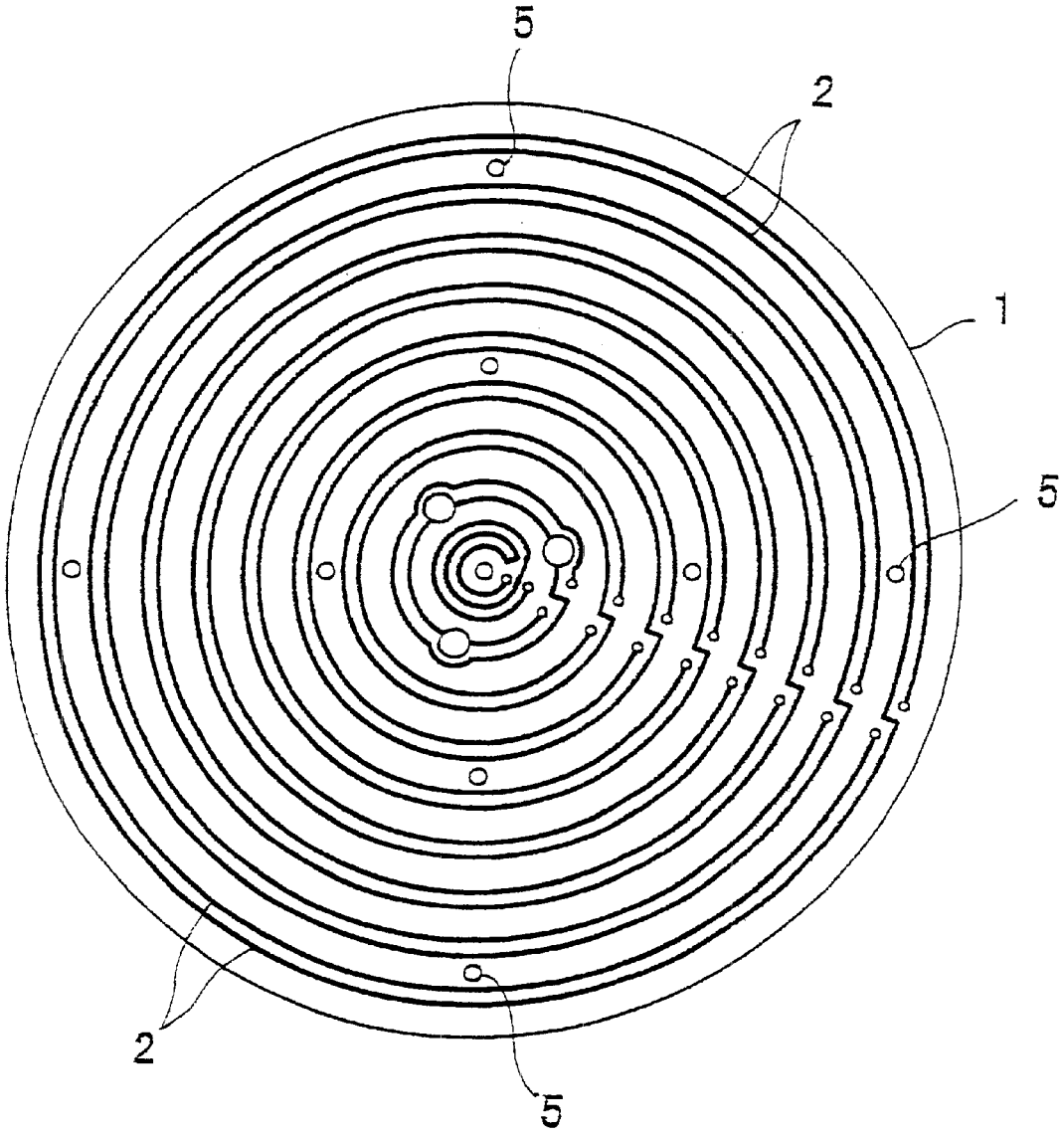
FIG. 1 is a schematic view of a bottom face of a ceramic heater (non-heating face)

As the pattern of the heating body formed on the surface of the ceramic substrate, it is desirable to adopt a pattern that a circuit is divided into at least two as shown in FIG. 1. By the division of the circuit is controlled a power applied to each circuit to change a heat generating quantity to thereby facilitate a temperature adjustment of a heating face. As such a heating body pattern, there can be adopted an eddy, a concentric circle, eccentric circle, bending line and the like.

As the other method of forming the heating body pattern according to the invention, there can be used a method wherein a rolled metal foil, plated-metal foil or electrically conductive ceramic thin film adhered onto the surface of the ceramic substrate is etched through an etching resist, a method wherein one previously punched into a given circuit is adhered onto the substrate through an adhesive (resin), and the like.

The ceramic substrate used in the invention is favorable to have a thickness of 0.5–25 mm, preferably 0.5–5 mm, more preferably about 1–3 mm. When the thickness is less than 0.5 mm, the breakage is easily caused, while when it exceeds 25 mm, heat capacity is too large and the temperature follow ability is degraded. Further, when it is more than 5 mm, there is no significant difference to the metal substrate.

As a material of the ceramic substrate, an oxide ceramic, a nitride ceramic, a carbide ceramic and the like can be used, but the nitride ceramic and carbide ceramic are particularly desirable. As the nitride ceramic, a metal nitride ceramic, for example, at least one selected from aluminum nitride, silicon nitride, boron nitride and titanium nitride is desirable. As the carbide ceramic, a metal carbide ceramic, for example, at least one selected from silicon carbide, zirconium carbide, titanium carbide, tantalum carbide and tungsten carbide is desirable.

Among these ceramics, aluminum nitride is most preferable. Because, the aluminum nitride is highest in the thermal conductive coefficient of 180 W/mK and excellent in the temperature follow ability.

In the invention, it is favorable that a thermocouple for the control of temperature, if necessary, is embedded in the ceramic substrate. Because, the temperature of the substrate is measured by the thermocouple and the voltage and current applied to the heating body can be changed based on the measured data to control the temperature of the substrate.

Figure 2:
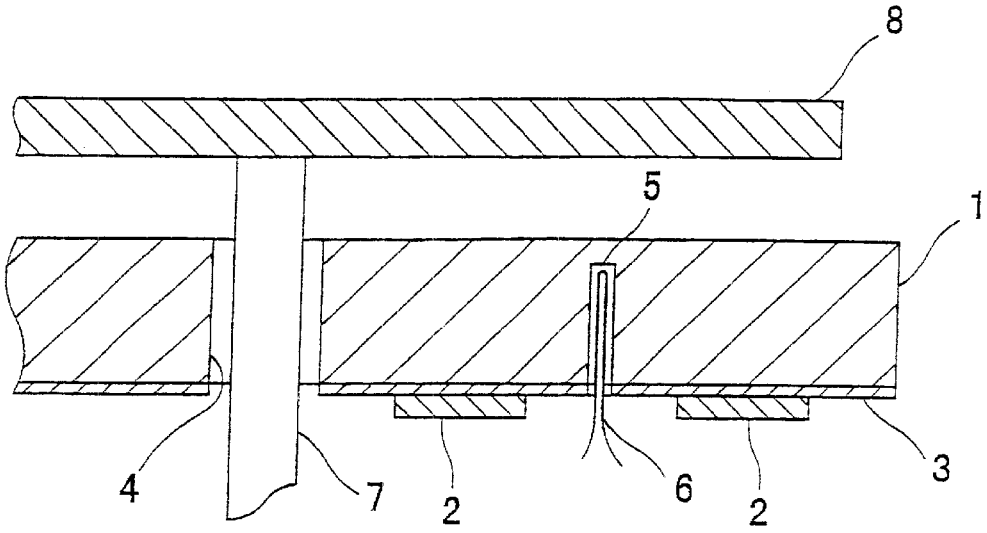
FIG. 2 is a diagrammatically partial section view illustrating an embodiment of the invention.
Figure 3:
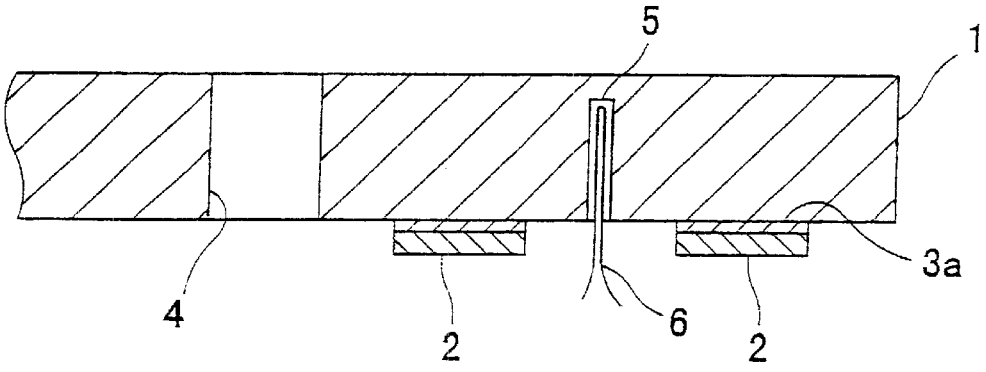
FIG. 3 is a diagrammatically partial section view illustrating another embodiment of the invention.

And also, the ceramic heater according to the invention can be used in such a form that plural through-holes 4 are formed in the ceramic substrate and support pins 7 are inserted into these through-holes 4 and a semiconductor wafer or other part is placed on tops of the pins to support facing to a heating face of the heater as shown in FIG. 2. These support pins can be moved in up and down directions, which is effective when the semiconductor wafer is delivered to a transferring machine (not shown) or the semiconductor wafer is received from the transferring machine.

Moreover, in the ceramic heater according to the invention, a face of the semiconductor wafer to be heated is opposite to a face of the substrate forming the heating body. Thus, the wafer can uniformly be heated because the heat diffusion effect is large.

Then, a production example of the ceramic heater according to the invention is described.

A. In case of forming a heating body on a surface of a ceramic substrate:

(1) A step that an insulating nitride ceramic or insulating carbide ceramic powder is well mixed with a binder or a solvent and shaped to obtain a shaped body, which is sintered to form a plate-shaped body of the nitride ceramic or carbide ceramic (ceramic substrate).

This step is a step that powder of aluminum nitride, silicon carbide or the like is added with a sintering aid such as yttria or the like and a binder and granulated by a method such as spray drying or the like and then the granulates are placed in a mold and pressurized to form a plate-shaped green body.

Moreover, the green shaped body may be provided with through-holes 4 inserting support pins 7 used for supporting a semiconductor wafer on a heating face of the substrate and a bottom hole 5 embedding a temperature measuring element 6 such as a thermocouple or the like, if necessary.

Then, the green shaped body is fired by heating and sintered to produce a ceramic plate-shaped body (ceramic substrate). In the firing by heating at this step, the pore-free ceramic substrate can be manufactured by pressuring the green shaped body. The firing by heating may be carried out above a sintering temperature. In the nitride ceramic or carbide ceramic, it is about 1000–2500° C.

(2) A step of forming a heating body on the ceramic substrate:

In this step, a previously and separately produced non-sintering type metal foil (rolled foil obtained by rolling a molten purified material, a plated foil obtained by electric plating or the like) or an electrically conductive ceramic thin film is etched with an acid, an alkali or the like, or punched to form a heating body pattern. This heating body pattern is placed on the surface of the substrate or the surface of non-sintering type metal foil or the electrically conductive ceramic thin film after the application of an uncured heat-resistant resin, an inorganic sol, a glass paste or the like and fixed by curing the heat-resistant resin or the inorganic Sol or by. firing the glass paste.

(3) To an end part of the heating body pattern is attached a terminal for the connection to a power source through a solder. And also, an end of the heating body pattern may be fixed by caulking without using the solder. In this point, the fixation by caulking is difficult in the sintering-type metal, but is possible in the non-sintering type metal foil used in the invention. Furthermore, a temperature measuring element 6 such as a thermocouple or the like is inserted into a bottom hole 5 pierced in the ceramic substrate from a non-heating face thereof and a heat-resistant resin such as polyimide or the like is filled in the hole and sealed together. Moreover, such a temperature measuring element may be a state of pressing (contacting) onto the surface of the substrate.

B. In case of forming a heating body in an inside of a ceramic substrate:

An insulating nitride ceramic or insulating Carbide ceramic powder is well mixed with a binder or a solvent and shaped into a green sheet, and a metal foil or an electrically conductive ceramic thin film is sandwiched between the green sheets to form a laminated body and then the laminate is hot pressed and fired.

Moreover, the green sheet may be with through-holes 4 inserting support pins 7 used for supporting a semiconductor wafer on a heating face of the substrate and a bottom hole 5 embedding a temperature measuring element 6 such as a thermocouple or the like, if necessary, as mentioned above.

Then, the green sheets are fired by heating and sintered to produce a ceramic plate-shaped body (ceramic substrate). In the firing by heating at this step, the pore-free ceramic substrate can be manufactured by pressuring the green sheets. The firing by heating may be carried out above a sintering temperature. In the nitride ceramic or carbide ceramic, it is about 1000–2500° C.

EXAMPLES

Example 1

Aluminum Nitride Ceramic Substrate (1) A composition comprising 100 parts by weight of aluminum nitride powder (average particle size 1.1 $\mu$m), 4 parts by weight of yttrium oxide (average particle size 0.4 $\mu$m), 12 parts by weight of an acryl binder and a balance of an alcohol is granulated by a spray drying method.

(2) The above granulated powder is placed in a mold and shaped into a flat plate to obtain a green shaped body. At given positions of the green shaped body are formed through-holes 4 for inserting support pins 7 supporting a semiconductor wafer and a bottomed hole 5 for embedding a thermocouple 6 by drilling.

(3) The above green shaped body is hot pressed at 1800° C. under a pressure of 200 kg/cm$^2$ to obtain an aluminum nitride plate-shaped body having a thickness of 3 mm. The plate-shaped body is cut out into a disc having a diameter of 210 mm as a plate-shaped ceramic substrate 1.

(4) There is provided a metal foil formed by adhering a polyethylene terephthalate film onto one-side surface of a rolled stainless steel sheet having a thickness of 20 $\mu$m, and further a photosensitive dry film is laminated onto the metal foil, which is exposed to a ultraviolet ray through a mask depicted with a heating body pattern and developed with an aqueous solution of 0.1% sodium hydroxide to form an etching resist.

Then, an etching treatment is carried out by immersing in a mixed solution of hydrofluoric acid and nitric acid and a development treatment is carried with an aqueous solution of 1 N sodium hydroxide to form a heating body pattern (foil-shaped pattern) on the polyethylene terephthalate film.

(5) An uncured polyimide is applied onto one-side surface of the ceramic substrate of item (3) and the heating body pattern (foil-shaped pattern) is placed thereon so as to adhere the metal surface to the uncured polyimide and integrally united by curing under heating at 200° C. Thereafter, polyethylene terephthalate film is peeled off.

(6) An Sn-Pb solder paste is printed on a portion attaching a pin for the connection of external terminal for ensuring connection to a power source by screen printing 1 to form a solder layer. Then, a pin of Koval for the connection of external terminal is placed on the solder layer and reflowed by heating at 360° C. to fix the terminal pin.

(7) A thermocouple 6 for the control of temperature is inserted into the bottomed hole 5 and a polyimide. resin is further filled and heated at 2000° C. to obtain a ceramic heater.

Example 2

Use of B-stage Resin

A ceramic heater is provided in the same manner as in Example 1 except that an acrylic tackifier is applied onto a ceramic substrate and a foil of stainless steel is placed thereon and polyethylene terephthalate film is peeled off and a polyimide of B-stage obtained by applying polyimide on a fluorine resin sheet and drying it is placed and integrally united by heating at 200° C. under pressure of 80 kg/cm$^2$ and then the fluorine resin film is peeled off.

Example 3

Embedding of Heating Body in Inside of Substrate (1) A green sheet having a thickness of 0.47 mm is shaped from a composition comprising 100 parts by weight of aluminum nitride powder (made by Tokuyama Co., Ltd. average particle size 1.1 $\mu$m), 4 parts by weight of yttria (average particle size 0.4 $\mu$m), 11.5 parts by weight of acryl binder, 0.5 part by weight of a dispersing agent and 53 parts by weight of alcohol mixture of 1-butanol and ethanol by a doctor blade method.

(2) After the green sheet is dried at 80° C. for 5 hours, a hole for through-hole for connecting a heating body to an external terminal pin is formed by punching.

(3) 100 parts by weight of tungsten carbide particles having an average particle size of 1 $\mu$m, 3.0 parts by weight of an acrylic binder, 3.5 parts by weight of $\alpha$-terpineol solvent and 0.3 part by weight of a dispersing agent are mixed and thinly applied onto an SiC substrate coated with BN powder and further another SiC substrate coated with BN powder is placed thereon and heated at 1900° C. under a pressure of 200 kg/cm$^2$ to obtain a tungsten carbide thin film having a thickness of 10 $\mu$m.

(4) The tungsten carbide thin film is punched to form a heating body pattern, and the heating body pattern is sandwiched between two or more green sheets to form a laminate, which is further hot pressed at 1800° C. under a pressure of 200 kg/cm$^2$ to obtain an aluminum nitride plate-shaped body having a thickness of 3 mm. This plate-shaped body is cut out into a disc having a diameter of 210 mm to provide a plate-shaped ceramic substrate.

(5) A hole exposing the tungsten carbide thin film is formed on the ceramic substrate by drilling and an external terminal is connected and fixed thereto with a gold solder (Ni—Au) and fixed with an inorganic adhesive (made by Toa Gosei Co., Ltd. Aronceramic).

Figure 6:
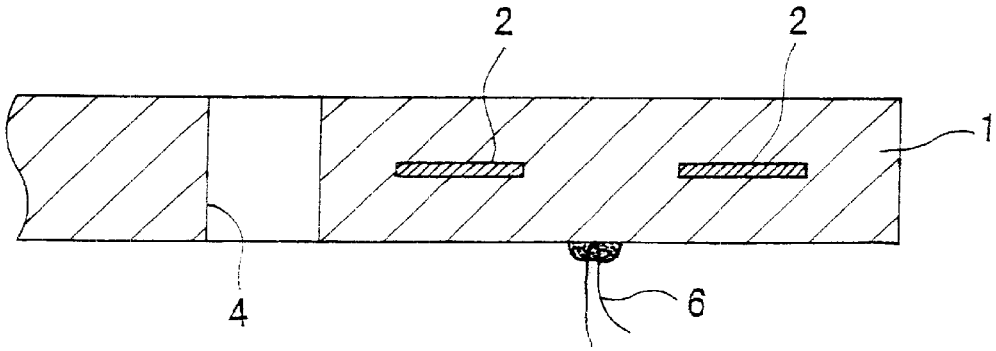
FIG. 6 is a diagrammatically partial section view illustrating a still further embodiment of the invention.

(6) Further, a thermocouple is fixed to the surface with an inorganic adhesive (made by Toa Gosei Co., Ltd. Aronceramic) (see FIG. 6).

Example 4

Glass Coating on SiC Surface (1) A composition comprising 100 parts by weight of silicon carbide powder (average particle size 1.1 $\mu$m), 4 parts by weight of $B_4C$ (average particle size 0.4 $\mu$m), 12 parts by weight of an acryl binder and the balance of alcohol is granulated by a spray drying method.

(2) The granulated powder is placed in a mold and shaped into a flat plate to obtain a green shaped body. At given positions of the green shaped body are formed through-holes 4 for inserting support pins 7 supporting a semiconductor wafer and a bottomed hole 5 for embedding a thermocouple 6 by drilling. (3) The green shaped body is hot pressed at 1980° C. under a pressure of 200 kg/cm$^2$ to obtain an SiC plate-shaped body having a thickness of 3 mm. The plate-shaped body is cut out into a disc having a diameter of 210 mm to obtain a ceramic plate-shaped substrate 1. (4) A glass paste (made by Shoei Kagaku Kogyo Co., Ltd. G-5117) is applied and the same stainless steel thin film as in Example 1 is placed and raised to 550° C. to integrally unite the stainless steel thin film and glass.

(5) An Sn-Pb solder paste is printed on a portion attaching a pin for the connection of external terminal for ensuring connection to a power source by screen printing 1 to form a solder layer. Then, a pin of Koval for the connection of external terminal is placed on the solder layer and reflowed by heating at 360° C. to fix the terminal pin.

(6) A thermocouple 6 for the control of temperature is fixed with a polyimide resin and heated at 200° C. to obtain a ceramic heater.

Comparative Example (1) A composition comprising 100 parts by weight of aluminum nitride powder (average particle size 1.1 $\mu$m), 4 parts by weight of yttrium oxide (average particle size 0.4 $\mu$m), 12 parts by weight of an acryl binder and a balance of alcohol is granulated by a spray drying method.

(2) The granulated powder is placed in a mold and shaped into a flat plate to obtain a-green shaped body. At given positions of the green shaped body are formed through-holes 4 for inserting support pins 7 supporting a semiconductor wafer and a bottomed hole 5 for embedding a thermocouple 6 by drilling.

(3) The green shaped body is hot pressed at 1800° C. under a pressure of 200 kg/cm$^2$ to obtain an aluminum nitride plate-shaped body having a thickness of 3 mm. The plate-shaped body is cut out into a disc having a diameter of 210 mm to obtain a ceramic plate-shaped substrate 1.

(4) On the ceramic substrate 1 of item (3) is printed an electrically conductive paste for the formation of heating body by a screen printing method. The printed pattern is a concentric circle pattern as shown in FIG. 1. As such an electrically conductive paste is used Solvent PS603D made by Tokuriki Kagaku Laboratory used in the formation of through-hole in a printed wiring board. The electrically conductive paste is a silver-lead paste and contains 7.5% by weight of metal oxides consisting of lead oxide, zinc oxide, silica, boron oxide and alumina (weight ratio of 5/55/10/25/5) based on weight of silver. Moreover, silver is scaly form having an average particle size of 4.5 $\mu$m.

(5) The ceramic substrate 1 printed with the electrically conductive paste is fired by heating at 780° C. to sinter silver and lead in the electrically conductive paste and bake on the surface of the substrate 1. The heating body pattern of silver-lead sintered body 4 has a thickness of 5 $\mu$m and a width of 2.4 mm and a surface resistivity of 7.7 m$\Omega/\square$.

(6) The ceramic substrate 1 of item (5) is immersed in an electroless nickel plating bath comprised of an aqueous solution of 30 g/l of nickel sulfate, 30 g/l of boric acid, 30 g/l of ammonium chloride and 60 g/l of Rochelle salt to-thicken the heating body pattern.

(7) A silver-lead solder paste is printed on a portion attaching an external terminal for ensuring connection to a power source to form a solder layer (made by Tanaka Kikinzoku Co., Ltd.). Then, a terminal pin of Koval is placed on the solder layer and reflowed by heating at 360° C. to fix the terminal pin to the surface of the heating body.

(8) A thermocouple for the control of temperature is inserted and a polyimide resin is filled to obtain a heater 100.

Example 5

The same procedure as in Example 4 is repeated except that a tungsten carbide thin film is used as a heating body.

With respect to the ceramic heaters of the examples and comparative example, the scattering of area resistance in the heating body is measured. The results are shown in Table 1, from which it is clear that the heating bodies according to the invention become smaller in the scattering.

And also, the ceramic heater is left to stand at 250° C. for 1000 hours to measure the presence or absence of the swelling in the heating body.

TABLE 1

| | Area resistance of heating body | State of swelling heating body |
|---|---|---|
| Example 1 | 7.5 ± 0.05 mΩ/□ | partly presence |
| Example 2 | 7.8 ± 0.05 mΩ/□ | partly presence |
| Example 3 | 33.0 ± 0.05 mΩ/□ | absence |
| Example 4 | 8.0 ± 0.03 mΩ/□ | absence |
| Example 5 | 38.0 ± 0.03 mΩ/□ | absence |
| Comparative Example | 7.7 ± 0.2 mΩ/□ | absence |

INDUSTRIAL APPLICABILITY

The ceramic heater according to the invention is small in the scattering of the resistance and can accurately and rapidly conduct the temperature control in the drying of a liquid resist on a wafer and the like. And also, it is useful as a ceramic heater used together with a static chuck, wafer prober or the like in the field of semiconductor industry.

What is claimed is:

1. A ceramic heater comprising a plate-shaped ceramic substrate and a heating body formed on a surface of the substrate or in an inside thereof and made of a non-sintering metal foil or an electrically conductive ceramic thin film.

2. A ceramic heater comprising a heating body formed on a surface of a plate-shaped ceramic substrate, and wherein the heating body is made of a non-sintering metal foil or an electrically conductive ceramic thin film and the metal foil is adhered and fixed to the surface of the substrate with an insulating material layer.

3. A ceramic heater comprising a heating body formed on a surface of a plate-shaped ceramic substrate, and wherein the heating body is made of a non-sintering metal foil or an electrically conductive ceramic thin film and the metal foil and the substrate are fixed together by covering with an insulating material.

4. A ceramic heater according to claim 1, wherein the heating body is formed on a face opposite to a heating face.

5. A ceramic heater according to claim 1, wherein the metal foil or electrically conductive thin film has a thickness of 10–50 Mm.

6. A ceramic heater comprising a plate-shaped ceramic substrate and a heating body of a non-sintering metal foil formed on a surface thereof.

7. A ceramic heater comprising a heating body formed on a surface of a plate-shaped substrate, and wherein the heating body is made of a non-sintering metal foil and the metal foil is adhered and fixed onto the surface of the substrate with a heat-resistant resin layer.

8. A ceramic heater comprising a heating body formed on a surface of a plate-shaped substrate, and wherein the heating body is made of a non-sintering metal foil and the metal foil and the substrate are covered and fixed together with a heat-resistant resin.

9. A ceramic heater according to claim 6, wherein the heating body is formed on a face opposite to a heating face.

10. A ceramic heater according to claim 6, wherein the metal foil is a dense rolled material or a plated material and has a thickness of 10–50 μm.

11. A ceramic heater according to claim 2, wherein the heating body is formed on a face opposite to a heating face.

12. A ceramic heater according to claim 3, wherein the heating body is formed on a face opposite to a heating face.

13. A ceramic heater according to claim 2, wherein the metal foil or electrically conductive thin film has a thickness of 10–50 μm.

14. A ceramic heater according to claim 3, wherein the metal foil or electrically conductive thin film has a thickness of 10–50 μm.

15. A ceramic heater according to claim 4, wherein the metal foil or electrically conductive thin film has a thickness of 10–50 μm.

16. A ceramic heater according to claim 7, wherein the heating body is formed on a face opposite to a heating-face.

17. A ceramic heater according to claim 8, wherein the heating body is formed on a face opposite to:a heating face.

18. A ceramic heater according to claim 7, wherein the metal foil is a dense rolled material or a plated material and has a thickness of 10–50 μm.

19. A ceramic heater according to claim 8, wherein the metal foil is a dense rolled material or a plated material and has a thickness of 10–50 μm.

20. A ceramic heater according to claim 9, wherein the metal foil is a dense rolled material or a plated material and has a thickness of 10–50 μm.

* * * * *

UNITED STATES PATENT AND TRADEMARK OFFICE

CERTIFICATE OF CORRECTION

PATENT NO. : 6,452,137 B1
DATED : September 17, 2002
INVENTOR(S) : S. Kariya

It is certified that error appears in the above-identified patent and that said Letters Patent is hereby corrected as shown below:

Column 9,
Line 50, "Mm" should be -- μm --.

Column 10,
Line 38, after "to" delete ":".

Signed and Sealed this

Eighth Day of April, 2003

JAMES E. ROGAN
*Director of the United States Patent and Trademark Office*